US007879521B2

(12) United States Patent
Kozuru et al.

(10) Patent No.: US 7,879,521 B2
(45) Date of Patent: Feb. 1, 2011

(54) ELECTROPHOTOGRAPHIC CARRIER, METHOD OF MANUFACTURING THE SAME, AND IMAGE FORMING METHOD EMPLOYING THE SAME

(75) Inventors: Hiroyuki Kozuru, Otsuki (JP); Yoshiaki Kobayashi, Hachioji (JP); Tatsuya Nagase, Tachikawa (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 915 days.

(21) Appl. No.: 11/755,957

(22) Filed: May 31, 2007

(65) Prior Publication Data

US 2007/0298339 A1 Dec. 27, 2007

(30) Foreign Application Priority Data

Jun. 27, 2006 (JP) ..... 2006-176272

(51) Int. Cl.
*G03G 9/00* (2006.01)

(52) U.S. Cl. ..... 430/111.1; 430/111.32; 430/111.41

(58) Field of Classification Search ..... 430/111.1, 430/111.32, 111.41
See application file for complete search history.

(56) References Cited

U.S. PATENT DOCUMENTS

2002/0015905 A1* 2/2002 Isonaka et al. ..... 430/111.35

FOREIGN PATENT DOCUMENTS

JP 09281751 10/1997

OTHER PUBLICATIONS

Japanese Office Action JP 2006-176272 and English Translation of Japanese Office Action.

* cited by examiner

*Primary Examiner*—Mark A Chapman
(74) *Attorney, Agent, or Firm*—Lucas & Mercanti, LLP

(57) ABSTRACT

An objective is to provide a highly durable carrier for a developer which is capable of forming a high-definition image stably with no deterioration of a developing property since the carrier resistance and the charging ability remain stable even though the developer is used for a long duration; a method of manufacturing the carrier; and an image forming method employing the same. Disclosed is an electrophotographic carrier comprising a carrier core material and provided thereon, a resin-coated layer comprising charge control particles and low-resistive particles, wherein an initial carrier resistance is $5\times10^{8}$-$3\times10^{10}$ Ωcm; a concentration of the low-resistive particles grows higher toward a surface of the layer from an inner part of the layer; and a concentration of the charge control particles grows lower toward a surface of the layer from an inner part of the layer.

6 Claims, 2 Drawing Sheets

ELECTROPHOTOGRAPHIC CARRIER, METHOD OF MANUFACTURING THE SAME, AND IMAGE FORMING METHOD EMPLOYING THE SAME

This application claims priority from Japanese Patent Application No. 2006-176272 filed on Jun. 27, 2006, which is incorporated hereinto by reference.

TECHNICAL FIELD

The present invention relates to an electrophotographic carrier, a method of manufacturing the same, and an image forming method employing the same.

BACKGROUND

In an electrophotographic image forming method, copied sheets are generally obtained via fixation with heat, pressure or solvent vapor, after an electrostatic latent image is formed by irradiating a photoconductive layer with an optical image depending on documents, the electrostatic latent image is developed by attaching colored powder called toner having a polarity opposite that of the latent image onto the electrostatic latent image, and a toner image is transferred to a transferred material such as paper, if desired.

As for a process of developing an electrostatic latent image, toner particles charged with a polarity opposite that of the latent image are attracted via electrostatic attraction, and adhered onto the electrostatic latent image, (in the case of a reversal development process, toner having the same polarity as that of the latent image charge is used), but generally, examples of the method of developing the electrostatic latent image with toners include two main types of methods such as a method of employing a so-called two-component developer in which a small amount of toners is dispersed in a medium called a carrier, and a method of employing a single-component developer in which toner is singly utilized without using a carrier.

Further, the carrier constituting a two-component developer is roughly classified into a conductive carrier and an insulating carrier. Oxidized or non-oxidized iron powder is commonly utilized as the conductive carrier, but there is a problem such that in the case of a developer containing this iron powder as a component, a frictional charging property is unstable to toner, and fog is generated in a visible image formed by the developer. That is, when such the developer is used, a bias current is lowered by increasing electrical resistance of carrier particles, and a frictional charging property becomes unstable since toner particles are adhered onto iron powder carrier particles with long-term use. As a result, image density of a formed visible image is lowered, and fog is increased.

On the other hand, a carrier, in which an insulating resin is evenly coated on the surface of a carrier core material made of iron, nickel, ferrite or such, is commonly known as a insulating carrier. In the case of a developer in which this carrier is employed, there is an advantage of being especially suitable for a high-speed electronic copying machine in view of excellent durability, and a long duration of use and life since fusion of toner particles on the carrier surface is slight in comparison to that of a conductive carrier.

Resistance of a carrier is also possible to be adjusted by coating the carrier surface, since generally, resistance of a core material used for a coated carrier is low, and resistance of a material used for a coated layer is high. Thus, Disclosed is a method of preventing adhesion of the carrier to an edge portion in a developing region during high-bias development, as well as preventing adhesion of the carrier to an image region during low-bias development, via resistance adjustment of the carrier by a process in which resistance of the coated layer is adjusted by dispersing carbon black (Patent Documents 1 and 2, for example), or metal oxide such as tin oxide, titanium oxide or zinc oxide (Patent Document 3, for example) in a coated layer in order to adjust resistance with thickness of the coated layer. However, there remains a problem such that a carrier resistance gradually declines, and the carrier is adhered to an image region, since the coated layer is diminished in quantity via friction, loss or such even though initial carrier resistance is adjusted by such the method.

Also disclosed is a method in which the amount of carbon black is designed to be larger toward the surface of a layer, and the amount of a charge control component (the amount of organic tin) is also designed to be larger toward the surface of a layer in order to stabilize the carrier resistance and the charging ability (Patent Document 4, for example). The carrier resistance is theoretically stabilized, and the charging ability becomes stable when the carrier resistance and the charging ability are adjusted by such the method, but the charging ability is degraded when resistance of the coated layer becomes large. That is, when the charging ability is lowered toward the lower portion of a layer, there is a problem produced such that from a practical standpoint, contamination and layer wear of the carrier surface are generated by toner and external additives, whereby the charging ability is degraded.

(Patent Document 1) Japanese Patent O.P.I. Publication No. 56-126843

(Patent Document 2) Japanese Patent O.P.I. Publication No. 62-45984

(Patent Document 3) Japanese Patent O.P.I. Publication No. 64-35561

(Patent Document 4) Japanese Patent O.P.I. Publication No. 7-160059

SUMMARY

The present invention is made on the basis of the above-described technological situation. Developer life, carrier resistance and charging ability are intimately associated with each other. Thus, it is an object of the present invention to provide a highly durable carrier for a developer which is capable of forming a high-definition image stably with no deterioration of a developing property since the carrier resistance and the charging ability remain stable even though the developer is used for a long duration; a method of manufacturing the carrier; and an image forming method employing the same. Also disclosed is an electrophotographic carrier comprising a surface of a carrier core material and provided thereon, a resin-coated layer comprising charge control particles and low-resistive particles, wherein an initial carrier resistance is $5\times10^{8}$-$3\times10^{10}$ Ωcm; a concentration of the low-resistive particles grows higher toward a surface of the layer from an inner part of the layer since the layer has a concentration gradient of the low-resistive particles in a thickness direction; and a concentration of the charge control particles grows lower toward a surface of the layer from an inner part of the layer since the layer has a concentration gradient of the charge control particles in the thickness direction.

BRIEF DESCRIPTION OF THE DRAWINGS

Embodiments will now be described, by way of example only, with reference to the accompanying drawings which are meant to be exemplary, not limiting, and wherein like elements numbered alike in several figures, in which.

DESCRIPTION OF THE PREFERRED EMBODIMENTS

Figure 1:
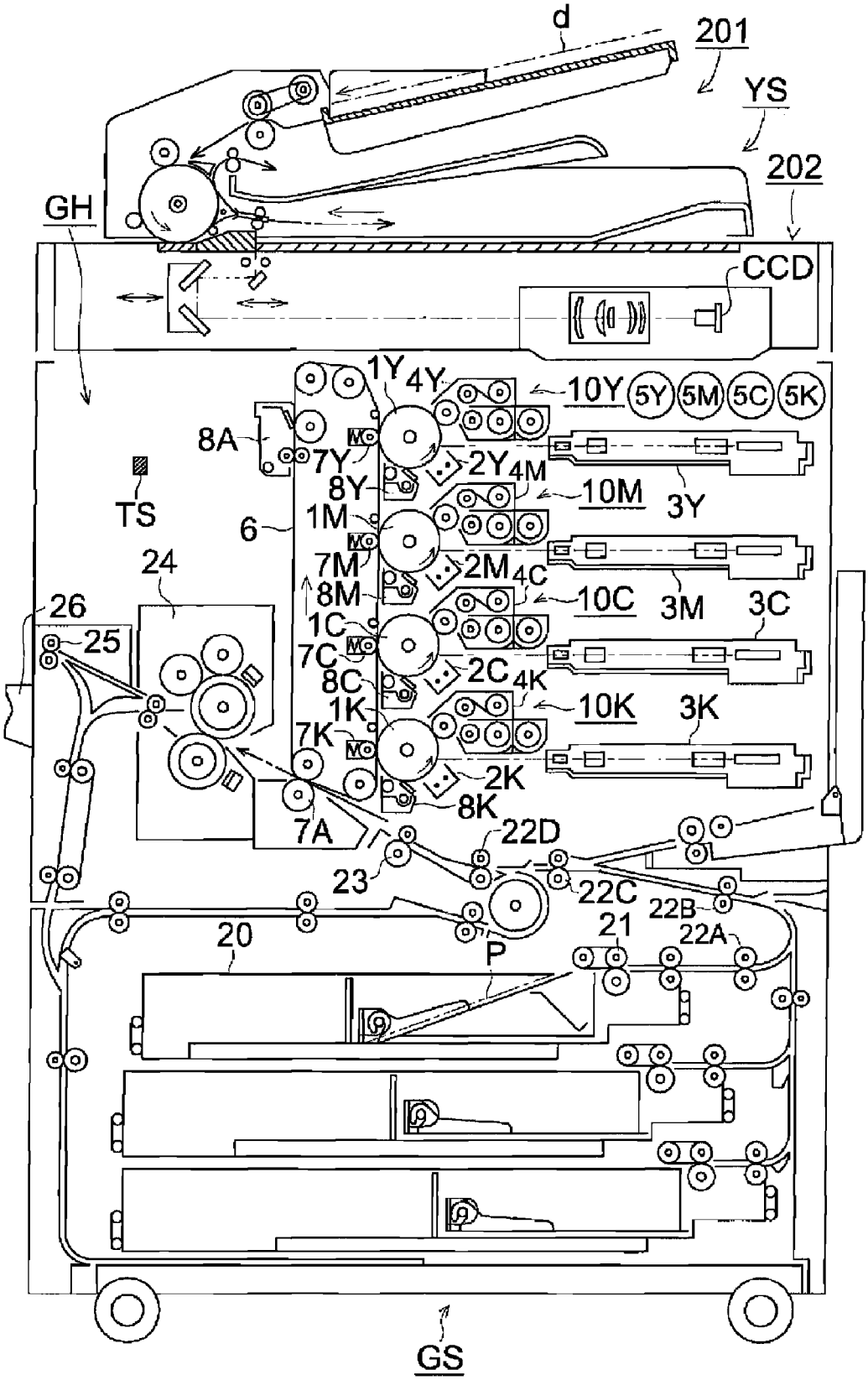
FIG. 1 is a schematic cross-sectional diagram of a color image forming apparatus showing one embodiment of an image forming apparatus of the present invention.

The above object of the present invention is accomplished by the following structures.

(Structure 1) An electrophotographic carrier comprising a carrier core material and provided thereon, a resin-coated layer comprising charge control particles and low-resistive particles, wherein an initial carrier resistance is $5\times10^8$-$3\times10^{10}$ Ωcm; a concentration of the low-resistive particles grows higher toward a surface of the layer from an inner part of the layer since the layer has a concentration gradient of the low-resistive particles in a thickness direction; and a concentration of the charge control particles grows lower toward a surface of the layer from an inner part of the layer since the layer has a concentration gradient of the charge control particles in the thickness direction.

(Structure 2) The electrophotographic carrier of Structure 1, wherein the charge control particles comprise a compound selected from the group consisting of strontium titanate, calcium titanate, magnesium oxide, an azine compound, a quarternary ammonium salt and triphenyl methane.

(Structure 3) The electrophotographic carrier of Structure 1 or 2, wherein the low-resistive particles comprise a compound selected from the group consisting of carbon black, zinc oxide and tin oxide.

(Structure 4) A method of manufacturing the electrophotographic carrier of any one of Structures 1-3, comprising the step of forming the resin-coated layer comprising the charge control particles and the low-resistive particles provided on the carrier core material.

(Structure 5) An image forming method comprising the steps of supplying a developer containing a toner and a carrier onto a developing sleeve; subsequently supplying the toner into an electrostatic latent image formed on an electrophotographic photoreceptor from the developing sleeve; conducting a developing treatment to visualize a toner image; transferring the visualized toner image into a recording sheet; and conducting a fixing treatment, wherein the developer comprises the electrophotographic carrier of any one of Structures 1-3 as the carrier, and wherein in a developing region, the developing sleeve and the photoreceptor rotate in the same direction.

While the preferred embodiments of the present invention have been described using specific terms, such description is for illustrative purposes only, and it is to be understood that changes and variations may be made without departing from the spirit or scope of the appended claims.

DETAILED DESCRIPTION OF THE INVENTION

It is a feature that the electrophotographic carrier of the present invention (thereinafter, also referred to simply as "carrier") is an electrophotographic carrier comprising a carrier core material and provided thereon, a resin-coated layer comprising charge control particles and low-resistive particles, wherein an initial carrier resistance is $5\times10^8$-$3\times10^{10}$ Ωcm; a concentration of the low-resistive particles grows higher toward a surface of the layer from an inner part of the layer since the layer has a concentration gradient of the low-resistive particles in a thickness direction; and a concentration of the charge control particles grows lower toward a surface of the layer from an inner part of the layer since the layer has a concentration gradient of the charge control particles in the thickness direction.

That is, the carrier of the present invention has a resistance which is lower toward the surface of a layer from the inner part of the layer, whereby charge ability is lowered. When the carrier is operated in an apparatus, the resin-coated layer becomes worn, and the surface contamination caused by toner and external additives is generated. When the layer becomes worn, carrier resistance becomes stable, since the carrier resistance lowered by diminishing the resin-coated layer in quantity as well as the carrier resistance raised by diminishing the low-resistive layer in quantity. The charging ability is degraded in the case of employing conventional structures since the layer wear and the surface contamination are caused with toner and external additives, but the charging ability is stabilized by containing a lot of charge control particles in a lower portion of the layer.

In the case of the carrier of the present invention, not so much specific resistance is lowered as that of a conventional product even though the coated layer becomes worn and thinner, when it is designed that specific resistance is lowered toward the surface of the coated layer as described before.

Next, the present invention and constituents thereof will be described in detail.

(Electrophotographic Carrier)

It is a feature that the electrophotographic carrier of the present invention comprises a resin-coated layer provided on the surface of a core material, and the resin-coated layer contains at least charge control particles and low-resistive particles. The initial carrier resistance means a value of resistance of carrier obtained by separating toner from a virgin developer, which was measured via the after-mentioned resistance measurement. In the case of an initial carrier resistance of less than $5\times10^8$ Ωcm, lots of carrier adhesion are generated, whereby image defects caused by drum scratch are generated since resistance becomes too low in the later half. On the other hand, In the case of an initial carrier resistance exceeding $3\times10^{10}$ Ωcm, an image producing an edge effect, in which image density is low at the center portion of the large-area copy image surface, and is high at the end of it at the initial stage of making practical camera exposure, is formed.

The initial carrier resistance employed in the present invention is $5\times10^8$-$3\times10^{10}$ Ωcm, and preferably $8\times10^8$-$1\times10^{10}$ Ωcm.

(Measurement of Carrier Resistance)

The carrier resistance of the present invention means resistance measured dynamically under the developing condition by a magnetic brush. A photoreceptor drum is replaced by an electrode drum made of aluminum having the same size as the photoreceptor drum to form a magnetic brush by supplying particles onto a developing sleeve, and the electrode drum is rubbed with this magnetic brush. The current flowing between the sleeve and the drum was measured after applying an voltage (500 V) between them to determine the resistance of carrier particles by the following equation.

$$DVR(\Omega\text{cm})=(V/I)\times(N\times Dsd)$$

DVR: Carrier resistance (Ωcm)

V: Voltage between a developing sleeve and a drum (V)

I: Measured current (A)

N: Developing nip width (cm)

L: Developing sleeve length (cm)

Dsd: Distance between a developing sleeve and a drum (cm)

In the present invention, measurements are carried out with V=500 V, N=1 mm, L=6 cm, and Dsd=0.6 mm.

Next, each of constituents will be described.

<<Charge Control Particle and Low-Resistive Particle>>

It is preferable that the charge control particle of the present invention is made of at least one compound selected from the compound group consisting of strontium titanate, calcium titanate, magnesium oxide, an azine compound, a quaternary ammonium salt and triphenylmethane.

The addition amount of each of the resin-coated charge control particles is preferably 2-40 parts by weight in the case of barium titanate, strontium titanate, calcium titanate and magnesium oxide, and also preferably 0.3-10 parts by weight in the case of an azine compound, a quaternary ammonium salt and triphenylmethane.

On the other hand, it is preferable that the low-resistive particle of the present invention is made of at least one compound selected from the compound group consisting of carbon black, zinc oxide and tin oxide.

The addition amount of each of the resin-coated low-resistive particles is preferably 2-40 parts by weight in the case of carbon black, preferably 2-150 parts by weight in the case of zinc oxide, and also preferably 2-200 parts by weight in the case of tin oxide.

<<Resin Coated Layer>>

Examples of the preferable resin to form a carrier coated layer include polyolefin based resins such as polyethylene, chlorinated polyethylene, chlorosulfonated polyethylene and so forth; polyvinyl and polyvinylidene based resins such as polyacrylate like polystyrene or polymethylmethacrylate, polyacrylonitrile, polyvinyl acetate, polyvinyl alcohol, polyvinyl butyral, polyvinyl chloride, polyvinyl carbazole, polyvinyl ether, polyvinylidene ketone and so forth; copolymers such as a vinyl chloride-vinyl acetate copolymer, a styrene-acrylic acid copolymer and so forth; a silicone resin or a modified resin thereof composed of an organo siloxane bond (for example, a modified resin made of an alkyd resin, a polyester resin, an epoxy resin or a polyurethane resin); fluorine resins such as polytetrachloroethylene, polyvinyl fluoride, polyvinylidene fluoride, polychlorotrifluoroethylene and so forth; polyamide; polyester; polyurethane; polycarbonate; amino resins such as a urea-formaldehyde resin and so forth; and epoxy resins. In addition, a silicone resin or a modified resin thereof, or a fluorine resin is preferable in view of prevention of toner-spent, but the silicone resin or the modified resin thereof is more preferable.

<<Preparation Method of Resin Coated Layer>>

Carrier coated layers of the present invention are formed with stepwise-varied or continuously varied density of charge control particles and low-resistive particles.

A coated layer having a multilayer structure is prepared by forming a plurality of coated layers having stepwise-varied densities by changing the kind and the amount of particles.

In the case of continuously varied particle density, for example, cores are initially introduced, and a speed of introducing the resin amount is arranged to remain constant, a coated layer, in which the nearer the region near the core material, the larger the amount of charge control particles is and the smaller the amount of low-resistive particles is, can be formed by gradually decreasing a speed of introducing the amount of charge control particles, and gradually increasing a speed of introducing the amount of low-resistive particles. In addition, concentration gradient in a resin layer is possible to be visually observed via, for example, the following method. A thin specimen of a carrier was prepared employing a focused ion beam specimen preparation system (SMI2050, manufactured by SII Nano Technology Inc.), and the cross-section of the thin specimen was subsequently observed at a magnification of approximately 5000 times employing a transmission electron microscope (JEM-2010F, manufactured by JEOL Ltd.) to confirm the concentration gradient.

Specific examples of the method for preparing a coated layer include a wet coating method and a dry coating method.

Specific examples of the wet coating method include the following methods.

(1) Fluidized Bed Spray Coating Method

This method is a method in which a coating solution prepared by dissolving a resin for coating in a solvent is spray-coated onto the magnetic material particle surface with a fluidized bed, and a drying process is subsequently conducted to form a coated layer.

(2) Immersion Coating Method

This method is a method in which magnetic material particles are immersed in a coating solution prepared by dissolving a resin for coating in a solvent to conduct a coating treatment, and a drying process is subsequently conducted to form a coated layer.

(3) Polymerization Method

This method is a method in which magnetic material particles are immersed in a coating solution prepared by dissolving a reactive compound in a solvent to conduct a coating treatment, and polymerization reaction is subsequently performed by applying heat to form a coated layer.

The dry coating method is a method in which resin particles are deposited on the coated particle surface, and the resin particles deposited on the surface are dissolved or softened via application of a mechanical impact force to be firmly fixed and to prepare a layer. Employing a high-speed stirring mixer capable of applying a mechanical impact force, usable for cores, resins, charge control particles and low-resistive particles under the condition of application or nonapplication of heat, an impact force is repeatedly applied to the admixture while high-speed stirring, and the mixture is dissolved or softened onto the magnetic material particle surface to prepare a firmly fixed carrier. When applying heat, a temperature of 60-125° C. is preferable, since coagulation of carrier particle-to-carrier particle is easily generated when heating temperature is too large.

<<Magnetic Material Particles>>

The magnetic material particles usable in the present invention are iron powder, magnetite, and various ferrite based particles or those dispersed in a resin. Of these, magnetite and various ferrite based particles are preferable. Preferable examples of the ferrite include a ferrite containing a heavy metal such as copper, zinc, nickel or manganese, and a light metal ferrite including at least one of an alkali metal and an alkaline earth metal. A light metal ferrite including at least one of an alkali metal and an alkaline earth metal is specifically preferable.

The composition of these magnetic material particles (carrier core) containing at least one of an alkali metal such as Li, Na or the like, and an alkaline earth metal such as Mg, Ca, Sr or Ba is as follows.

$$(M_2O)_x(Fe_2O_3)_{1-x} \text{ or } (MO)_x(Fe_2O_3)_{1-x}$$

A part of $(M_2O)$ and/or $(Fe_2O_3)$ may further be substituted by an alkaline earth metal oxide. M represents at least one of an alkali metal such as Li, Na or the like, and an alkaline earth metal such as Mg, Ca, Sr or Ba. Also, x is at most 30 mol %, or preferably at most 18 mol %, and furthermore 1-10 mol % of a substituted alkaline earth metal oxide is preferable, and 3-15 mol % of the substituted alkaline earth metal oxide is more preferable.

The reason why this light metal ferrite or magnetite is preferable is that weight of carrier itself can be trimmed, whereby stress to toner can be relieved, in addition to an effective response to waste and environmental pollution problem as a major issue in recent years.

A magnetic material particle diameter is 10-100 μm in volume-based average particle diameter, and preferably 20-80 μm. Further, a saturation magnetization of $2.5\times10^{-5}$-$10.0\times10^{-5}$ Wb·m/kg is preferable as a magnetization characteristic of the carrier itself.

In addition, the volume-based average particle diameter of magnetic material particles can be measured by a laser diffraction type particle size distribution analyzer "HELOS" (manufactured by SYMPATEC Co.) equipped with a wet type homogenizer.

The saturation magnetization is measured employing an automatic recording device for D.C. magnetization characteristics 3257-35 (manufactured by Yokogawa Electric Co., Ltd.).

(Preparation of Electrophotographic Toner)

Toner is not specifically limited.

[Image Forming Method]

It is a feature in the present invention that an image forming method comprising the steps of supplying a developer containing a toner and a carrier onto a developing sleeve; subsequently supplying the toner into an electrostatic latent image formed on an electrophotographic photoreceptor from the developing sleeve to conduct a developing treatment; and transferring a visualized toner image into a recording sheet to conduct a fixing treatment, wherein the developer comprises the electrophotographic carrier of claim 1 as the carrier, and wherein in a developing region, the developing sleeve and the photoreceptor rotate in the same direction. Thus, a carrier of the present invention produces an excellent effect in the case of a developing system in which a photoreceptor drum and a developing sleeve rotate in the same direction (forward direction developing system) as described above, because an edge effect is easily generated since an amount of toner supplied to a developing nip section is small in the case of the forward direction developing system, compared with a developing sleeve in which the developing sleeve rotates in the direction opposite to the photoreceptor drum (reverse direction developing system).

Figure 2:
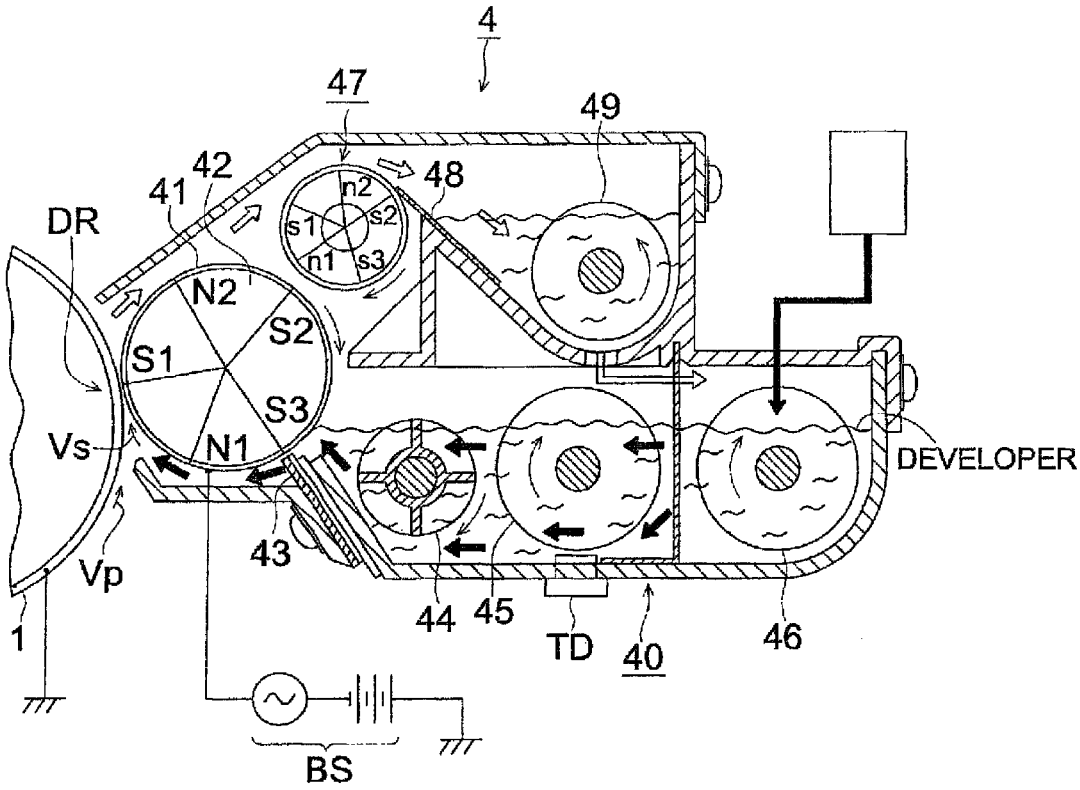
FIG. 2 is a schematic cross-sectional diagram showing an example of a developing unit in FIG. 1.

An example of the image forming apparatus as a forward direction developing system will be described below, referring to FIG. 1 and FIG. 2. FIG. 1 is a schematic cross-sectional diagram of a color image forming apparatus showing one embodiment of an image forming apparatus of the present invention. FIG. 2 is a schematic cross-sectional diagram showing an example of a developing unit in FIG. 1.

In FIG. 1, image forming apparatus GS is constituted by image forming apparatus main body GH and image reading device YS.

Image forming apparatus main body GH is commonly called a tandem type color image forming apparatus and is constituted by multiple image forming units 10Y, 10M, 10C, and 10K, belt-shaped intermediate transfer member 6, a sheet feed and conveyance device, and fixing device 24.

Image forming unit 10Y to form yellow (Y) images is fitted with charging unit 2Y, exposure unit 3Y, developing unit 4Y, and cleaning unit 8Y located around photoreceptor drum 1Y as an image carrier. Image forming unit 10M to form magenta (M) images is equipped with photoreceptor drum 1M as an image carrier, charging unit 2M, exposure unit 3M, developing unit 4M, and cleaning unit 8M. Image forming unit 10C to form cyan (C) images is equipped with photoreceptor drum 1C as an image carrier, charger 2C, exposure unit 3C, developing unit 4C, and cleaning unit 8C. Image forming unit 10K to form black (K) images is equipped with photoreceptor drum 1K as an image carrier, charging unit 2K, exposure unit 3K, developing unit 4K and cleaning unit 8K. Charging unit 2Y and exposure unit 3Y, charging unit 2M and exposure unit 3M, Charging unit 2C and exposure unit 3C, and charging unit 2K and exposure unit 3K each constitute a latent image forming unit.

Intermediate transfer member 6 is held so as to be rolled by a plurality of rollers and to be able to be rotated. An image of each color formed by image forming unit 10Y, 10M, 10C and 10K is transferred onto the rotating intermediate transfer member by transferring units 7Y, 7M, 7C and 7K one after another (primary transfer) to form a composite color image. Recording sheet P stored in paper cassette 20 is fed one after another by paper feeding roller 21 and conveyed to transferring unit 7A through paper feeding rollers 22A, 22B 22C and 22D, and resist roller 23, to transfer the color image onto recording sheet P (secondary transfer). Recording sheet P onto which the color image has been transferred is subjected to a fixing treatment with fixing device 24, held in between with eject paper roller 25, and piled on eject paper tray 26 outside the apparatus.

Meanwhile, after transferring a color image onto recording sheet P with transfer unit 7A, and separating recording sheet P by a small radius of transfer unit 7A, intermediate transfer member 6 is cleaned to remove residual toner with cleaning unit 8A.

Each of developing units 4Y, 4M, 4C and 4K comprises a two-component developer composed of a small particle diameter toner of yellow (Y), magenta (M), cyan (C) and black (K) each, and a carrier, and each of toner supply units 5Y, 5M, 5C and 5 K supplies new toner to each of developing units 4Y, 4M, 4C and 4K.

Image reading device YS comprising automatic document feeder 201 and document image scanning and exposing unit 202 is placed on the top of main body GH of the image forming apparatus. Document d placed on the document tray of automatic document feeder 201 is delivered to document image scanning and exposing unit 202 by a conveyance device. One-sided or two-sided faces of the document are exposed and scanned by the optical system of document image scanning and exposing unit 202 and read into a line image sensor of CCD.

Line image sensor of CCD converts light into analog signals photo-electrically and sends the signals to an image processor for analog processing, A/D conversion, shading correction, image compression, etc. After processing, the resulting image data is sent to each of image writing sections (or exposure units) 3Y, 3M, 3C, and 3K.

Automatic document feeder 201 is provided with an automatic double-sided document conveyance mechanism. This automatic document feeder 201 reads the contents of a plurality of documents d continuously in one operation, and the documents are possible to be stored in a memory unit (electronic RDH function). This function is conveniently operated when a plurality of documents are copied by the copying function or a plurality of documents d are sent by the facsimile function.

Incidentally, temperature and humidity sensor TS is installed in the inside of image forming apparatus main body GH as an environment condition detecting sensor. A counter to count the number of copy sheets, which is connected to a developing control section is also installed in image forming apparatus main body GH.

Next, developing units 4Y, 4M, 4C and 4K are typified by developing unit 4, and photoreceptor drums 1Y, 1M, 1C and 1K are also typified by photoreceptor drum 1 to explain the developing unit used for an image forming apparatus of the present invention below, referring to FIG. 2. In addition, a two-component developer is referred to also as a developer in the following description. Further, black-out arrows indicate the direction of supply and conveyance of a two-component developer to a developer carrier, and white arrows indicate the direction of peeling and collecting the two-component developer from the developer carrier.

Developing unit 4 is composed of developing unit frame 40, developing roller 41 as a developer carrier, magnetic field generator 42 (magnet roll), regulating unit 43 having a thickness adjustment plate, paddle wheel type supply unit 44, stirring screw 45 and 46 for stirring and conveyance, peeling roller 47, peeling plate 48, collecting unit 49 having a screw, toner density detecting sensor TD, and so forth.

An electrostatic latent image is developed in developing region DR via counterclockwise rotation of peripheral velocity Vp indicated by an arrow of photoreceptor drum 1, and clockwise rotation of peripheral velocity Vs indicated by an arrow of developing roller 41. A developing bias obtained by superimposing a direct current having the same polarity as that of the latent image on an alternating current bias is applied to developing roller 41 by bias power source BS to conduct a reversal development process.

Developing roller 41 is placed to face photoreceptor drum 1 by which an electrostatic latent image is carried, and is supported so as to be rotatable, and a developer is conveyed to developing region DR via the rotation as indicated by the arrow to form a developer layer necessary for a developing process by carrying a developer in developing region DR.

Example

Next, the present invention will be described in detail, referring to the following examples, but the present invention is not specifically limited thereto. Incidentally, "parts" in the description represents "parts by weight".

(Preparation of Carrier 1)

One hundred parts by weight of core particles (magnetic particles) having a particle diameter of 35 μm, 1.4 parts by weight of acrylic resin, 0.07 parts by weight of Mogul-L (5 parts by weight, based on the acrylic resin) and 0.07 parts by weight of barium titanate (5 parts by weight, based on the acrylic resin) are charged into a high-speed stirring mixer to repeatedly apply an impact force to the admixture while high-speed stirring, and the resulting mixture is dissolved or softened onto the magnetic material particle surface to form internal layer 1.

Next, 1 part by weight of acrylic resin, 0.1 parts by weight of Mogul-L (10 parts by weight, based on the acrylic resin), and 0.03 parts by weight of barium titanate (3 parts by weight, based on the acrylic resin) are charged into the above-described mixer to repeatedly apply an impact force to the admixture while high-speed stirring, and the resulting mixture is dissolved or softened onto the surface of the magnetic material particle, in which internal layer 1 is formed, to form a surface layer.

Incidentally, each layer thickness in the examples was calculated by the following equation.

(Layer thickness)=(Amount of resin in weight per carrier)/(Surface area per carrier)·(Specific gravity of resin)=(⅙)·(Average carrier particle diameter)·(Specific gravity of carrier)·(Total amount of resin in weight)/(Specific gravity of resin)

(Preparation of Carriers 2-7)

<Carrier 2>

Carrier 2 was prepared similarly to preparation of Carrier 1, except that not only 1.9 parts by weight of acrylic resin of internal layer 1 and 1.4 parts by weight of acrylic resin of surface layer were employed, but also the amount and the kind of low-resistive particles and charge control particles as shown in Table 1 were added into each layer.

<Carrier 3>

Carrier 3 was prepared similarly to preparation of Carrier 1, except that not only 2.8 parts by weight of acrylic resin of internal layer 1 and 1.4 parts by weight of acrylic resin of surface layer were employed, but also the amount and the kind of low-resistive particles and charge control particles as shown in Table 1 were added into each layer.

<Carrier 4>

In the preparation method of Carrier 1, 0.5 parts by weight of acrylic resin of internal layer 1 is employed to form internal layer 2, 1.4 parts by weight of acrylic resin of surface layer is employed to form internal layer 1, and 0.5 parts by weight of acrylic resin is further employed for the surface layer to repeatedly apply an impact force to the admixture while high-speed stirring, and the resulting mixture is dissolved or softened onto the surface of the magnetic material particle, in which internal layer 1 is formed, to form a surface layer.

Particles added into each of internal layer 1, internal layer 2 and the surface layer are shown in Table 1.

<Carrier 5>

Carrier 5 was prepared similarly to preparation of Carrier 1, except that not only 1.4 parts by weight of acrylic resin of internal layer 1 and 1.0 part by weight of acrylic resin of surface layer were employed, but also the amount and the kind of low-resistive particles and charge control particles as shown in Table 1 were added into each layer.

<Carrier 6>

Carrier 6 was prepared similarly to preparation of Carrier 1, except that not only 1.0 part by weight of acrylic resin of internal layer 1 and 1.0 part by weight of acrylic resin of surface layer were employed, but also the amount and the kind of low-resistive particles and charge control particles as shown in Table 1 were added into each layer.

<Carrier 7>

Carrier 6 was prepared similarly to preparation of Carrier 1, except that not only 0.4 parts by weight of acrylic resin of internal layer 1 and 1.0 part by weight of acrylic resin of surface layer were employed, but also the amount and the kind of low-resistive particles and charge control particles as shown in Table 1 were added into each layer.

TABLE 1

| | | | Surface layer | | | Internal layer 1 | | | Internal layer 2 | | |
|---|---|---|---|---|---|---|---|---|---|---|---|
| Carrier No. | Low-resistive particle | Charge control particle | *1 | Amount of charge control particle (parts) | Layer thickness (μm) | *1 | Amount of charge control particle (parts) | Layer thickness (μm) | *1 | Amount of charge control particle (parts) | Layer thickness (μm) |
| Carrier 1 | Mogul-L (carbon black) | Barium titanate | 10 | 3 | 0.2 | 5 | 5 | 0.3 | — | — | — |
| Carrier 2 | Mogul-L (carbon black) | Magnesium oxide | 30 | 10 | 0.3 | 20 | 20 | 0.4 | | | |
| Carrier 3 | Pastran 3400 (tin oxide) | Bontron N-7 | 10 | 0.5 | 0.3 | 3 | 1 | 0.6 | | | |
| Carrier 4 | VXC-72R (carbon black) | Barium titanate | 10 | 2 | 0.1 | 5 | 4 | 0.3 | 2 | 8 | 0.1 |
| Carrier 5 | Mogul-L (carbon black) | Barium titanate | 15 | 3 | 0.2 | 35 | 5 | 0.3 | | | |
| Carrier 6 | Pastran 3400 (tin oxide) | Magnesium oxide | 10 | 3 | 0.2 | 5 | 1 | 0.2 | | | |
| Carrier 7 | Mogul-L (carbon black) | Barium titanate | 3 | 1 | 0.2 | 1 | 2 | 0.3 | | | |

*1: Amount of low-resistive particle (parts)

Parts described in Table 1 as the amount of low-resistive particles and the amount of charge control particles are those based on the resin used in the same layer.

<Preparation of Developer>

Hundred parts by weight of each carrier produced above and 4 parts by weight of black toner were mixed employing a homogenizer to prepare Developers 1-7.

In addition, the toner having a volume-based median particle diameter ($D_{50}$) of 6.0 μm was employed, and prepared via a so-called polymerization method as a manufacturing method.

(Evaluation)

After arranging to prepare a developer and a toner cartridge by using carriers as shown in Table 1, and Bk toner, an image having a pixel ratio of 10% in black toner monochrome (an original image document allocating four equal quarters for each of a text image having a pixel ratio of 7%, a portrait, a solid white image, and a solid black image) was output to evaluate images employing a copier converted for experiments (8050, manufactured by Konica Minolta Business Technologies, Inc.), and to further evaluate images at an initial stage and after the output of 1,000,000 prints.

(Carrier Adhesion)

After the output of the $1^{st}$ print, $500{,}000^{th}$ print and $1{,}000{,}000^{th}$ print, a non-image chart was developed, and the number of carriers adhered to the photoreceptor surface was counted for 5 visual fields via loupe observation to designate the average number of adhesion carriers per 100 $cm^2$ as the amount of carrier adhesion.

Evaluation Criteria:

A: At most 20

B: At least 21 and less than 50

C: At least 50

A and B are accepted, but C is not accepted.

(Edge Effect)

At the initial stage of printing, an image in which a solid image having an image density of 1.2-1.3 exists was printed at the rear printed image portion of a solid half-tone image having an image density of 0.5 to evaluate whether or not a white patch is generated in a half-tone image being around an edge with a solid image.

A: No white patch is generated.

B: No white patch is generated, but image density is slightly less.

C: White patch is generated.

A and B are accepted, but C is not accepted.

(Fog)

The absolute image density of not printed white paper was measured at 20 points employing a Macbeth reflection densitometer RD-918, and the calculated average value was specified as the white paper density. Next, the absolute density of the white image portion in the $1{,}000{,}000^{th}$ formed image for evaluation was similarly measured at 20 points, and the average value was calculated to evaluate the value obtained via subtraction of the white paper density from the average density, as fog density. In the case of the fog density of at most 0.010, fog produces no problem in practical use.

A: Less than 0.003

B: At least 0.003 and less than 0.006

C: At least 0.006 and at most 0.010

D: Larger than 0.010

(Image Density)

The image density was measured in relative density employing a Macbeth reflection densitometer RD-918 when paper density was set to 0.

A: Each density at the Bk solid image portion is at least 2. (Excellent)

B: Each density at the Bk solid image portion is at least 0.8 and less than 1.2. (No problem in practical use)

C: Each density at the Bk solid image portion is less than 0.8.

The above-described evaluation results are shown in Table 2.

TABLE 2

| | Carrier No. | *1 (Ωcm) | Carrier adhesion *2 | *3 | *4 | Edge effect | Fog | Image density |
|---|---|---|---|---|---|---|---|---|
| Example 1 | Carrier 1 | $9.0 \times 10^9$ | A | A | B | B | A | B |
| Example 2 | Carrier 2 | $6.0 \times 10^8$ | A | B | B | A | B | A |
| Example 3 | Carrier 3 | $1.5 \times 10^{10}$ | A | A | B | B | B | B |
| Example 4 | Carrier 4 | $8.0 \times 10^9$ | A | A | A | B | A | B |
| Comp. 1 | Carrier 5 | $7.0 \times 10^8$ | B | C | C | B | D | A |
| Comp. 2 | Carrier 6 | $9.0 \times 10^9$ | B | B | B | B | D | C |
| Comp. 3 | Carrier 7 | $5.0 \times 10^{10}$ | A | A | A | C | B | B |

Comp.: Comparative example,
*1: Initial carrier resistance
*2: 1st print,
*3: 500,000th print, and
*4: 1,000,000th print As is clear from Table 2, is to be understood that high-quality images can be continuously obtained for a long duration, since the resistance and charging property of carriers are stable even though a developer, for which a coated carrier of the present invention is employed, is used for a long duration.

EFFECT OF THE INVENTION

The foregoing Structures of the present invention can provide a highly durable carrier for a developer which is capable of forming a high-definition image stably with no deterioration of a developing property since the carrier resistance and the charging ability remain stable even though the developer is used for a long duration; a method of manufacturing the carrier; and an image forming method employing the same.

What is claimed is:

1. An electrophotographic carrier comprising a carrier core material and provided thereon, a resin-coated layer comprising charge control particles and low-resistive particles, wherein an initial carrier resistance is $5\times10^8$-$3\times10^{10}$ Ωcm;

a concentration of the low-resistive particles grows higher toward a surface of the layer from an inner part of the layer since the layer has a concentration gradient of the low-resistive particles in a thickness direction; and a concentration of the charge control particles grows lower toward a surface of the layer from an inner part of the layer since the layer has a concentration gradient of the charge control particles in the thickness direction.

2. The electrophotographic carrier of claim 1, wherein the charge control particles comprise a compound selected from the group consisting of strontium titanate, calcium titanate, magnesium oxide, an azine compound, a quarternary ammonium salt and triphenyl methane.

3. The electrophotographic carrier of claim 1, wherein the low-resistive particles comprise a compound selected from the group consisting of carbon black, zinc oxide and tin oxide.

4. A method of manufacturing the electrophotographic carrier of claim 1, comprising the step of:

forming the resin-coated layer comprising the charge control particles and the low-resistive particles provided on the carrier core material.

5. An image forming method comprising the steps of:

(a) supplying a developer containing a toner and a carrier onto a developing sleeve;

(b) subsequently supplying the toner into an electrostatic latent image formed on an electrophotographic photoreceptor from the developing sleeve;

(c) conducting a developing treatment to visualize a toner image;

(d) transferring the visualized toner image into a recording sheet; and (e) conducting a fixing treatment, wherein the developer comprises the electrophotographic carrier of claim 1 as the carrier, and wherein in a developing region, the developing sleeve and the photoreceptor rotate in the same direction.

6. The electrophotographic carrier of claim 1, wherein the charge control particles comprise an inorganic compound selected from the group consisting of barium titanate, strontium titanate, calcium titanate and magnesium oxide.

* * * * *